US006296538B1

(12) United States Patent
Chamberlain et al.

(10) Patent No.: US 6,296,538 B1
(45) Date of Patent: Oct. 2, 2001

(54) INSULATION DIAPHRAGM FOR GETTER FLASH TURNTABLE AND METHOD OF IMPLEMENTING AND USING SAME

(75) Inventors: Michael J. Chamberlain, San Diego; David Allen Murtishaw, Temecula, both of CA (US)

(73) Assignees: Sony Corporation, Tokyo (JP); Sony Electronics, Inc., Park Ridge, NJ (US)

( * ) Notice: Subject to any disclaimer, the term of this patent is extended or adjusted under 35 U.S.C. 154(b) by 0 days.

(21) Appl. No.: 09/479,241

(22) Filed: Jan. 7, 2000

(51) Int. Cl.[7] ..... H01J 9/44; H01J 9/38
(52) U.S. Cl. ..... 445/5
(58) Field of Search ..... 445/5

(56) References Cited

U.S. PATENT DOCUMENTS 4,214,798 * 7/1980 Hopen ..... 445/5
4,272,701 * 6/1981 Gallaro et al. ..... 313/479
4,398,897 * 8/1983 Nubani et al. ..... 445/5
4,473,774 * 9/1984 Hernqvist ..... 313/479
4,940,440 * 7/1990 Rehkopf et al. ..... 445/5

* cited by examiner

*Primary Examiner*—Kenneth J. Ramsey
(74) *Attorney, Agent, or Firm*—Ronald P. Kananen; Rader, Fishman & Grauer

(57) ABSTRACT

An insulating diaphragm can be disposed on the saddle of getter flash turntable or other fixture used to support a cathode ray tube during frit knocking with a high voltage. The diaphragm protects the integrity of the cathode ray tube by preventing arcing of the high voltage through the neck of the cathode ray tube and into the supporting saddle.

20 Claims, 2 Drawing Sheets

INSULATION DIAPHRAGM FOR GETTER FLASH TURNTABLE AND METHOD OF IMPLEMENTING AND USING SAME

FIELD OF THE INVENTION

The present invention relates to the field of cathode ray tube manufacture. More specifically, the present invention relates to a device and method for preventing arcing that punctures the neck glass of a cathode ray tube during the evaluation of frit strength and vacuum integrity.

BACKGROUND OF THE INVENTION

Cathode ray tubes ("CRTs") are well known in modern society. The CRT is the principal component in such common devices as television and computer monitors. As shown in FIG. 1, a CRT (100) typically includes a relatively flat display portion (101) (upper portion as seen in FIG. 1). When one is watching television or looking at a computer monitor, that person is looking at the flat display portion (101) of a cathode ray tube.

During manufacture, an electro-luminescent material is coated over the display portion (101) of the CRT. The display portion (101) is then joined to the funnel (102) using a glass paste compound known as frit to complete the cathode ray tube shown, for example, in FIG. 1). An electron gun (106) is then placed at the end of the CRT's "neck" (102). When the CRT is operated, a yoke (not shown) creating an electromagnetic field causes the stream of electrons (105) emitted from the electron gun (106) to scan in lines across the surface of the display portion (101).

Where the stream of electrons (105) hits the electro-luminescent material, the electro-luminescent material emits light. Thus, by rapidly switching the electron stream (105) on and off, or by varying the power of the electron stream as it sweeps across the display portion of the CRT, an image can be formed in the light emitted by the electro-luminescent material. This is the general principle on which CRTs operate.

After the display portion (101) of the tube is joined to the funnel (102) and the joint between the two is sealed with frit, the completed tube is evacuated. Then, the strength of the frit seal and the integrity of the vacuum are evaluated. This evaluation is known as "frit knocking" and is performed with a high voltage being applied from within the cathode ray tube (100).

Unfortunately, it is not uncommon for the high voltage (105) to arc (107) out of the neck (102) of the CRT (100) and into the support fixture (120). This may result in a puncture of the CRT neck (102) at the point where the arcing (107) occurred. This degrades the quality of the CRT or renders it unusable.

Consequently, there is a need in the art for a device and method that prevents the arcing of the high voltage so as to avoid punctures in the neck of the CRT during the frit knocking, i.e., the evaluation of the frit integrity.

SUMMARY OF THE INVENTION

It is an object of the present invention to meet the above-described needs and others. Specifically, it is an object of the present invention to provide an apparatus and method for preventing the arcing of the high voltage used to evaluate the frit seal of a cathode ray tube so as to avoid punctures in the neck of the CRT during frit knocking.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve these stated and other objects, the present invention may be embodied and described as a cathode ray tube processing device having a saddle for receiving and supporting the cathode ray tube during frit knocking using a high voltage; and an isolation diaphragm disposed on the saddle so as to be between the saddle and the cathode ray tube when the cathode ray tube is supported by the saddle. The isolation diaphragm prevents arcing of the high voltage through the cathode ray tube to the saddle.

Preferably, the diaphragm is made of a non-conductive material, such as silicone. Preferably, the diaphragm is about 2 mm thick as measured between the saddle and the cathode ray tube.

The diaphragm should be adhered to the saddle with a non-conductive adhesive. The diaphragm has a funnel shape conforming to the interior opening of the saddle and the neck portion of a cathode ray tube. In this way, the saddle and diaphragm receive and support the cathode ray tube.

The present invention also encompasses a method of manufacturing a cathode ray tube using the diaphragm described above. In other words, the present invention expressly encompasses a method of preventing arcing of an internal high voltage through the cathode ray tube to a saddle supporting the cathode ray tube during frit knocking using the high voltage. The arcing is prevented with an isolation diaphragm disposed on the saddle so as to be between the saddle and the cathode ray tube when the cathode ray tube is supported by the saddle.

BRIEF DESCRIPTION OF THE DRAWINGS

The accompanying drawings illustrate the present invention and are a part of the specification. Together with the following description, the drawings demonstrate and explain the principles of the present invention.

DETAILED DESCRIPTION OF THE PREFERRED EMBODIMENTS

Figure 1:
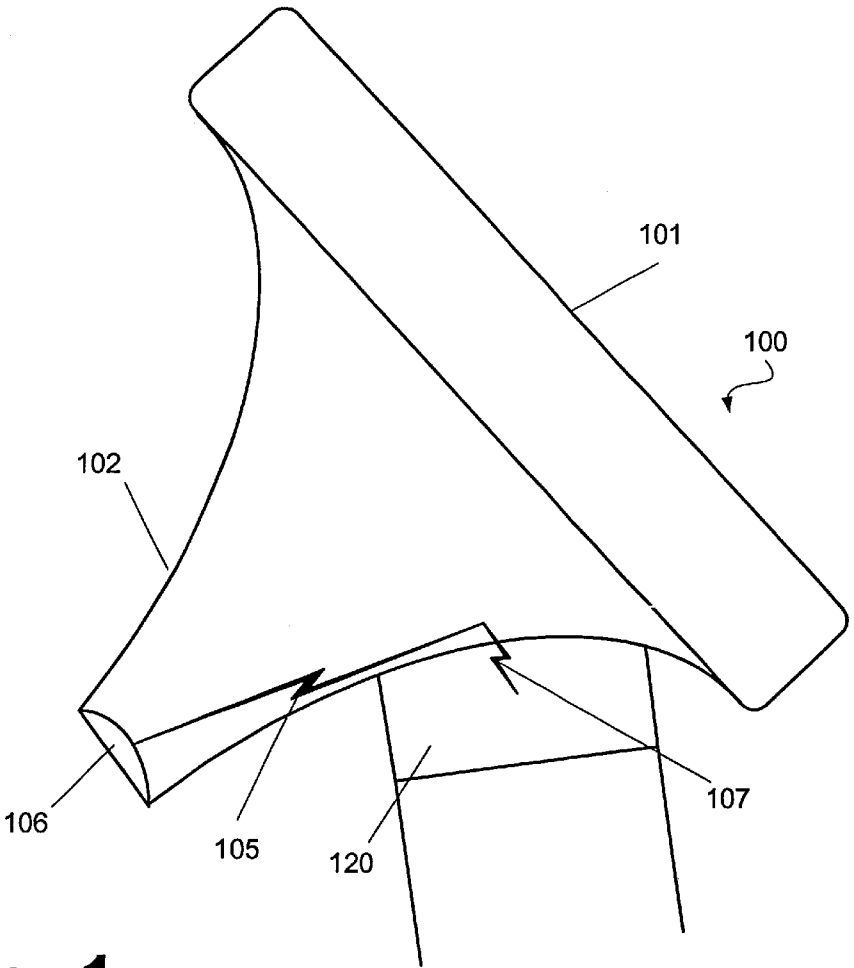
Fig. 1 (Prior Art)
FIG. 1 is an illustration of the prior art method of manufacturing cathode ray tubes.

Using the drawings, the preferred embodiments of the present invention will now be explained.

Under the principles of the present invention, to verify the integrity of the frit, i.e., to knock the frit, the CRT (100) is disposed on a getter flash turntable (108) or other fixture. The turntable includes a saddle (103) which has a conical or funnel-shaped opening that is sized and shaped to receive the neck and funnel (102) of the CRT (100). Thus, the saddle (103) holds and supports the CRT (100) on the getter flash turntable (108).

The frit of the CRT (100) is grounded and a high-voltage, approximately 42 kV, is applied to the inside of the tube (100). This allows the strength of the frit and the integrity of the vacuum within the tube to be evaluated. However, as noted above, it is not uncommon for the application of the high voltage to result in an arc (107, FIG. 1) that passes through and damages the cathode ray tube (100).

In order to prevent the deleterious arcing (107; FIG. 1) of the high voltage (105), the present invention provides an isolation diaphragm (200) that is disposed between the saddle (103) of the getter flash turntable (108) and the neck (102) of the CRT (100). The diaphragm (200), in position on the saddle (103), is illustrated in FIG. 2.

The diaphragm (200) must be made of a non-conductive material that will electrically insulate and isolate the saddle (103) from the high voltage (105). Preferably, the diaphragm (200) is made from silicone.

Figure 2:
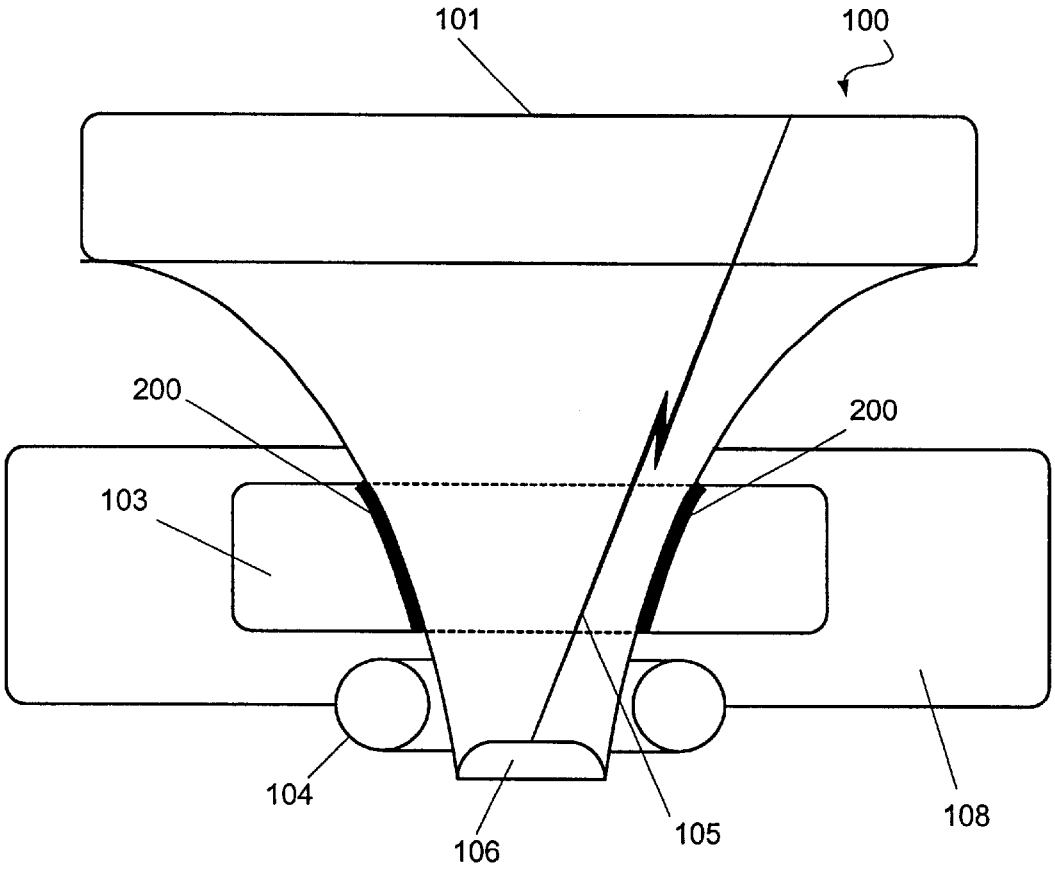
FIG. 2 is an illustration of a CRT manufacturing device and method according to the present invention.

The diaphragm (200) should preferably by about 1 to 2 mm thick as measured between interior and exterior surfaces, i.e., between surface in contact with the saddle (103) and that in contact with the neck (102) of the CRT (100) as illustrated in FIG. 2. A diaphragm (200) with that thickness has been found to adequately insulate the saddle (103) from the high voltage (105) at 42 kV such as that used to knock the frit of the tube (100).

With the diaphragm (200) in place, as shown in FIG. 2, the high voltage (105) is not prone to arc through the neck (102) of the tube (100) and into the saddle (103). As a result, puncture or degradation of the neck (102) is avoided, and CRTs (100) can be more reliably and efficiently manufactured.

The shape of the diaphragm (200) is dictated in conformance to the saddle (103). The diaphragm (200) should be conical in shape so as to conform to both the exterior of the neck and funnel (102) of the CRT (100) and the interior of the saddle (103).

The opening in the saddle (103) may be enlarged to accommodate the diaphragm (200) so that the saddle (103) continues to contact the same portion of the funnel (102) of the CRT (100) as would have been the case prior to application of the diaphragm (200). Thus, the addition of the diaphragm (200) should not alter the positional relationship between the CRT (100) and the frit knocking equipment.

The diaphragm (200) can be secured to the saddle (103) using any non-conductive adhesive. Adhesives from the class generally known as "super glue" are considered satisfactory for use in practicing the present invention.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A cathode ray tube processing device comprising:

a fixture for receiving and supporting said cathode ray tube during frit knocking with a high voltage; and an isolation diaphragm disposed on said fixture so as to be between said fixture and said cathode ray tube when said cathode ray tube is supported by said fixture, said isolation diaphragm preventing arcing of said high voltage to said fixture.

2. The device of claim 1, wherein said fixture is a saddle having a conical, funnel-shape for receiving a funnel and neck of said cathode ray tube therein.

3. The device of claim 1, wherein said diaphragm is made of a non-conductive material.

4. The device of claim 2, wherein said diaphragm is made of silicone.

5. The device of claim 1, wherein said diaphragm is about 2 mm thick as measured between said fixture and said cathode ray tube.

6. The device of claim 1, wherein said diaphragm is adhered to said fixture with a non-conductive adhesive.

7. The device of claim 1, wherein said diaphragm has a funnel shape conforming to a neck portion of said cathode ray tube.

8. A method of manufacturing a cathode ray tube, the method comprising the steps of:

preventing arcing of a high voltage, used for frit knocking, through said cathode ray tube to a fixture; and supporting said cathode ray tube during said frit knocking, wherein said preventing step is performed with an isolation diaphragm disposed on said fixture so as to be between said fixture and said cathode ray tube when said cathode ray tube is supported by said fixture.

9. The method of claim 8, further comprising making said diaphragm of a non-conductive material.

10. The method of claim 9, further comprising making said diaphragm of silicone.

11. The method of claim 8, further comprising making said diaphragm about 2 mm thick as measured between said fixture and said cathode ray tube.

12. The method of claim 8, further comprising adhering said diaphragm to said fixture with a non-conductive adhesive.

13. The method of claim 8, further comprising making said diaphragm with a funnel shape conforming to a neck portion of said cathode ray tube.

14. A cathode ray tube processing device comprising:

means for receiving and supporting said cathode ray tube during a frit knocking process using a high voltage; and means for electrically isolating said means for receiving and supporting said cathode ray tube so as to prevent arcing of said high voltage through said cathode ray tube to said means for receiving and supporting said cathode ray tube.

15. An isolation diaphragm for a cathode ray tube processing device comprising:

an isolation diaphragm for application on a saddle of a cathode ray tube processing apparatus which receives and supports a cathode ray tube during a frit knocking process using a high voltage;

wherein said isolation diaphragm prevents arcing of said high voltage through said cathode ray tube to said saddle when disposed between said saddle and a cathode ray tube supported by said saddle.

16. The diaphragm of claim 15, wherein said diaphragm is made of a non-conductive material.

17. The diaphragm of claim 16, wherein said diaphragm is made of silicone.

18. The diaphragm of claim 15, wherein said diaphragm is about 2 mm thick as measured between said saddle and said cathode ray tube.

19. The diaphragm of claim 15, wherein said diaphragm is adhered to said saddle with a non-conductive adhesive.

20. The diaphragm of claim 15, wherein said diaphragm has a funnel shape conforming to a neck portion of said cathode ray tube.

* * * * *